US012465146B2

(12) United States Patent
Shen et al.

(10) Patent No.: US 12,465,146 B2
(45) Date of Patent: Nov. 11, 2025

(54) FOLDABLE SWING

(71) Applicant: Linhai Sunrise Leisure Products Co., Ltd., Linhai (CN)

(72) Inventors: Huaqiang Shen, Linhai (CN); Yilun Liu, Linhai (CN)

(73) Assignee: Linhai Sunrise Leisure Products Co., Ltd., Linhai (CN)

( * ) Notice: Subject to any disclaimer, the term of this patent is extended or adjusted under 35 U.S.C. 154(b) by 0 days.

(21) Appl. No.: 18/969,175

(22) Filed: Dec. 4, 2024

(65) Prior Publication Data

US 2025/0089894 A1 Mar. 20, 2025

(30) Foreign Application Priority Data

Nov. 27, 2024 (CN) ..... 202411720917.9

(51) Int. Cl.

| | |
|---|---|
| ***A47C 3/025*** | (2006.01) |
| ***A45F 3/26*** | (2006.01) |
| ***A47C 3/26*** | (2006.01) |
| ***A47C 4/28*** | (2006.01) |
| ***A47C 4/38*** | (2006.01) |
| ***A47C 4/48*** | (2006.01) |
| ***A47C 7/54*** | (2006.01) |
| ***A47C 7/66*** | (2006.01) |
| ***A63G 9/00*** | (2006.01) |
| ***A63G 9/02*** | (2006.01) |

(52) U.S. Cl.

CPC ..... *A47C 3/0255* (2013.01); *A45F 3/26* (2013.01); *A47C 4/28* (2013.01); *A47C 4/38* (2013.01); *A47C 4/48* (2013.01); *A63G 9/00* (2013.01); *A63G 9/02* (2013.01)

(58) Field of Classification Search

CPC ..... A47C 3/0255; A47C 4/28; A47C 4/38; A47C 4/48; A45F 3/26; A63G 9/00; A63G 9/02

USPC ..... 5/120, 121, 122, 124, 127, 128; 297/32, 297/56, 184.15, 184.17, 273, 277, 281, 297/258.1; 472/118

See application file for complete search history.

(56) References Cited

U.S. PATENT DOCUMENTS

| | | | | |
|---|---|---|---|---|
| 827,417 A * | 7/1906 | Calbeck et al. | ..... | A47C 1/0345 297/69 |
| 1,266,744 A * | 5/1918 | Worzalla | ..... | A47C 3/0255 297/324 |
| 1,389,682 A * | 9/1921 | Melniker | ..... | A47D 9/02 5/128 |
| 2,630,313 A * | 3/1953 | Pearl | ..... | A63G 9/00 297/217.2 |

(Continued)

FOREIGN PATENT DOCUMENTS

WO WO-8605081 A1 * 9/1986

*Primary Examiner* — Robert Canfield

(57) ABSTRACT

The present invention discloses a foldable swing, including support frames and a swing seat, where the swing seat is connected to the support frames by hangers, the support frame includes a first support rod, a second support rod and a connecting rod, the two support rods are arranged one in front of the other in a cross-hinged manner, the connecting rod is located between the two support rods, and both ends of the connecting rod are respectively movably connected to the two support rods. The present invention can achieve folding or unfolding of the foldable swing.

11 Claims, 11 Drawing Sheets

(56) References Cited

U.S. PATENT DOCUMENTS

| | | | | |
|---|---|---|---|---|
| 4,229,845 | A * | 10/1980 | de Cuadros | E04H 15/324 5/127 |
| 5,802,635 | A * | 9/1998 | Chen | A47D 9/02 5/127 |
| 6,019,427 | A * | 2/2000 | Combest | B60P 3/36 297/277 |
| 6,951,369 | B1 * | 10/2005 | Wang | A47C 3/0255 297/281 |
| 8,684,458 | B2 * | 4/2014 | Lee | A47C 7/407 297/277 |
| 2006/0261652 | A1 * | 11/2006 | Tseng | A47C 7/66 297/277 |
| 2013/0033075 | A1 * | 2/2013 | Lee | A47C 7/407 297/184.1 |
| 2021/0068558 | A1 | 3/2021 | Gopaul | |
| 2021/0100341 | A1 | 4/2021 | Tsanev et al. | |
| 2024/0306819 | A1 | 9/2024 | Chen | |

* cited by examiner

FOLDABLE SWING

TECHNICAL FIELD

The present invention relates to the technical field of swings, and particularly relates to a foldable swing.

BACKGROUND

Swing chairs are a type of household items. With the improvement of living standards, more and more people place swing chairs on home terraces or in gardens, so that they can take swing chairs in their spare time to relieve stress and maintain a comfortable mood. The existing swings are generally completely disassembled and assembled, occupy a large floor area, take a long time to mount, and need to be completely disassembled for the purpose of storage, which brings inconvenience to the next use, and increases the number of disassembly and assembly, resulting in decreased fastening effect of parts and a risk of loss of small parts.

SUMMARY

The purpose of the present invention is to provide a foldable swing designed to solve the above-mentioned technical deficiencies.

The present invention relates to a foldable swing, including: a swing seat, support frames located on both sides of the swing seat, and hangers, where the swing seat is connected to the support frames by the hangers.

The support frame includes a first support rod, a second support rod and a connecting rod, the first support rod and the second support rod are hingedly connected, and both ends of the connecting rod are respectively connected to the first support rod and the second support rod and deviate from a hinged point to limit an unfolding angle of the first support rod and the second support rod. The swing seat includes a backrest frame body and a cushion frame body, and the backrest frame body is hinged with the cushion frame body.

The foldable swing has an unfolded state and a folded state, in the unfolded state, the first support rod and the second support rod are rotated about the hinged point for unfolding, and the backrest frame body and the cushion frame body form an unfolded seat state, and in the folded state, the first support rod and the second support rod nearly overlap, and the backrest frame body and the cushion frame body are rotated for folding.

The present invention has the following technical effect: the support frames are respectively arranged on both sides of the swing seat, each support frame includes a first support rod and a second support, the first support rod and the second support rod on the same side are arranged one in front of the other in a cross-hinged manner, and a connecting rod bendable downward to be folded is provided between lower portions of the first support rod and the second support rod, so that the two support rods can be folded quickly; the swing seat includes a backrest frame body, an armrest frame body and a cushion frame body, the backrest frame body and the armrest frame body are integrated, and the cushion frame body is hinged to the integrated backrest frame body and armrest frame body to achieve folding, therefore the whole swing can be folded quickly by simple and direct operations without scattered parts; the support rods, the connecting rod, transverse support rods, the backrest frame body, the armrest frame body and the cushion frame body are all hollow tube structures, so that the swing seat has an light overall weight; the backrest frame body, the armrest frame body and the cushion frame body are formed by enclosing the hollow tubes, and a flexible support material is connected to the hollow tubes and is tightened to form a backrest surface and a cushion surface, which not only minimizes the overall weight but also ensures comfort; and the whole swing can be folded without disassembling fasteners or parts, which avoid the problem of being unable to be folded or normally used due to loss of parts.

Figure 1:
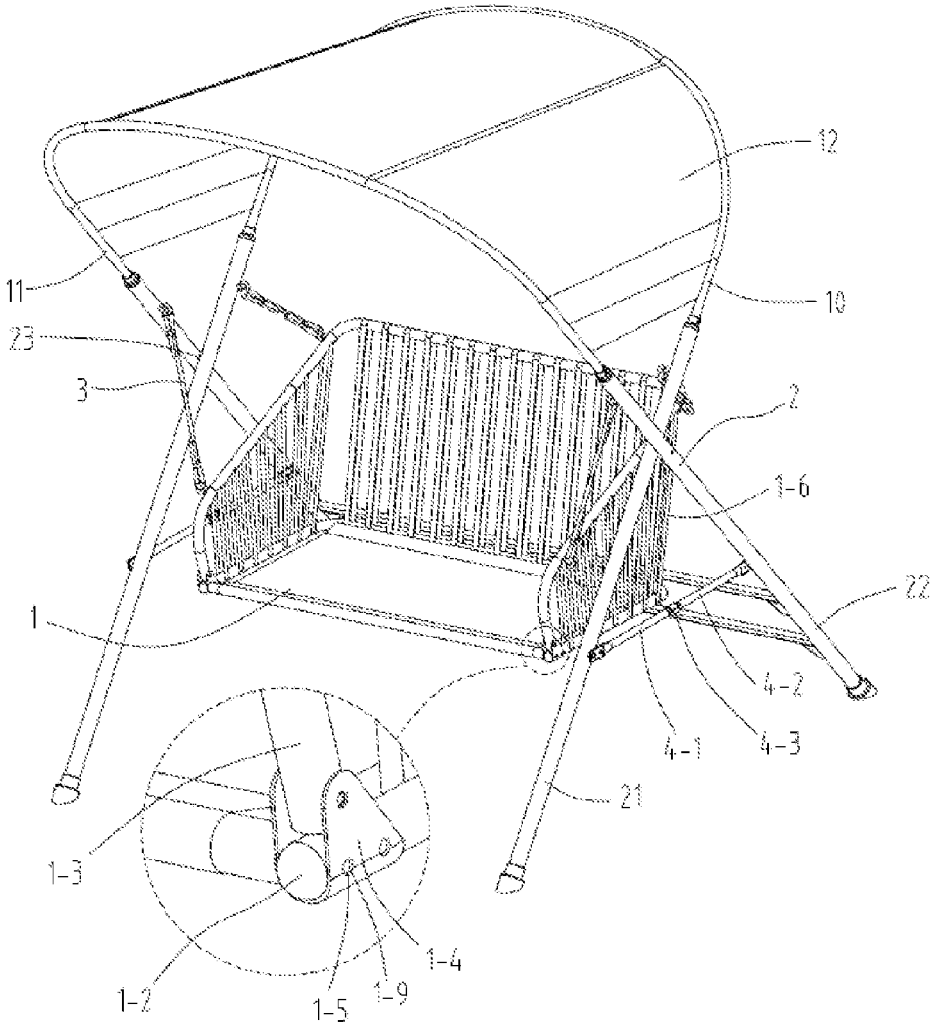
FIG. 1 is a front view of an overall structure of the present invention in an unfolded state.
Figure 2:
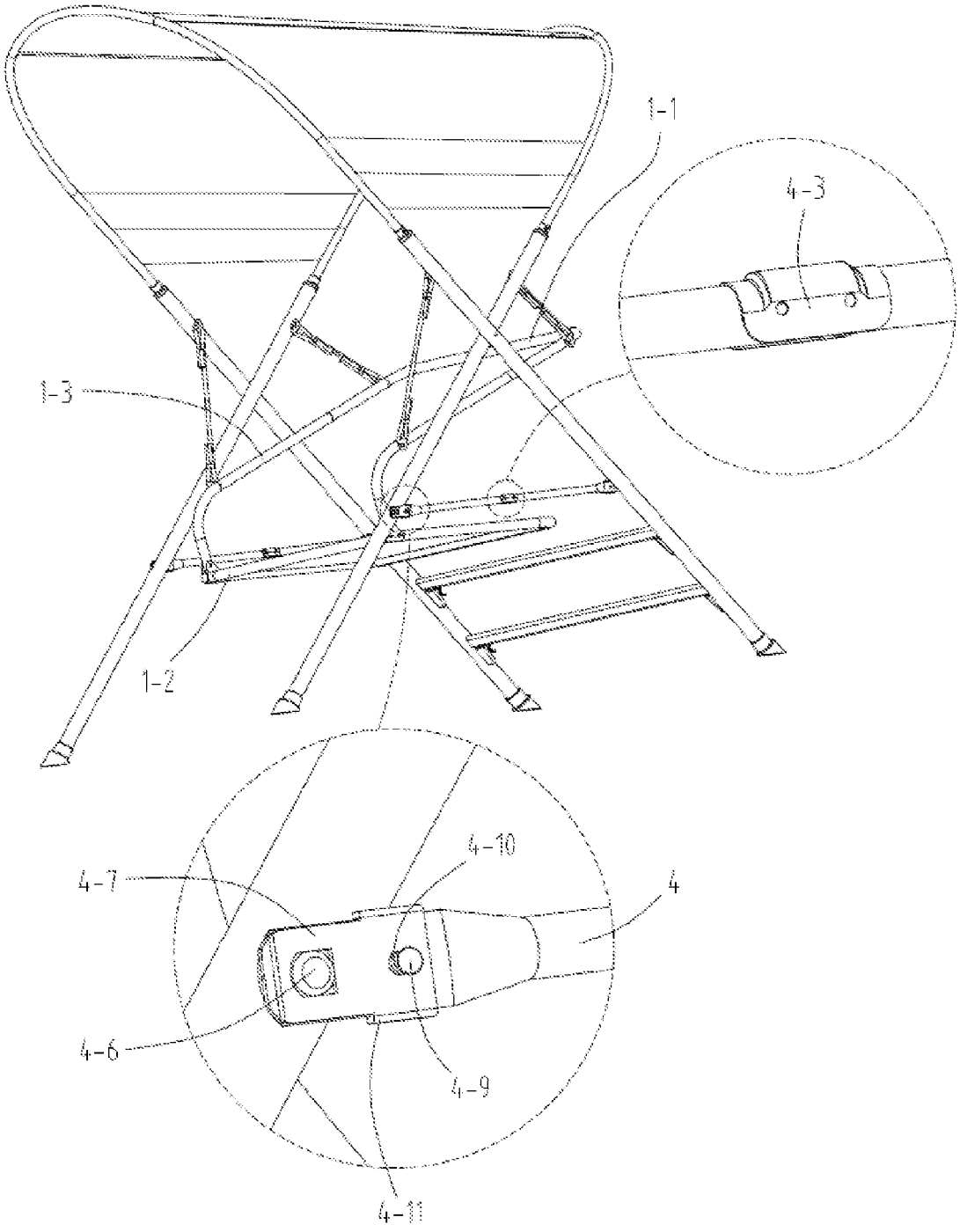
FIG. 2 is a view of the overall structure of the present invention viewed from another perspective in the unfolded state.
Figure 3:
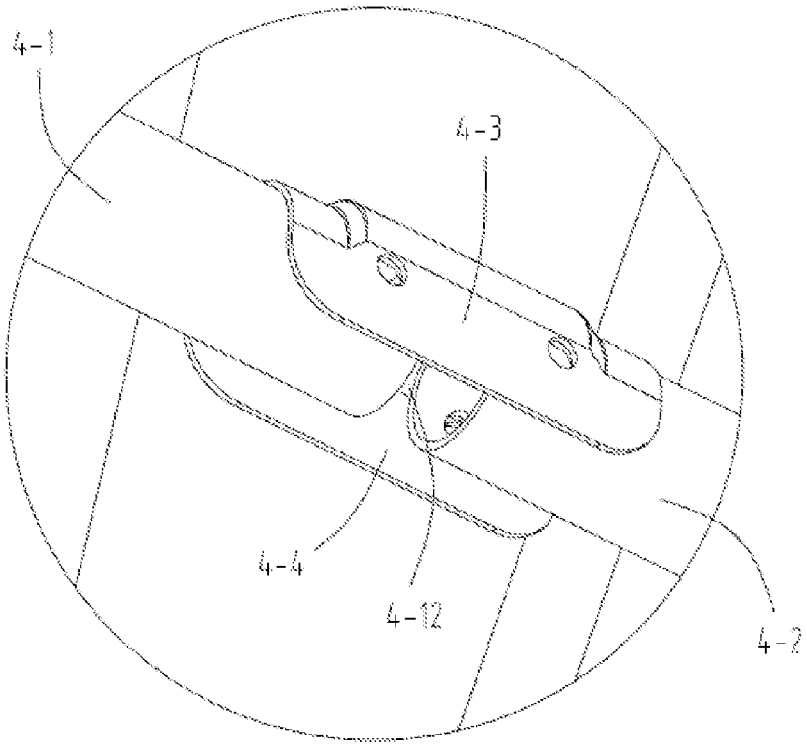
FIG. 3 is a diagram of a connection structure of a first rod portion, a second rod portion and a first connector of the present invention.
Figure 4:
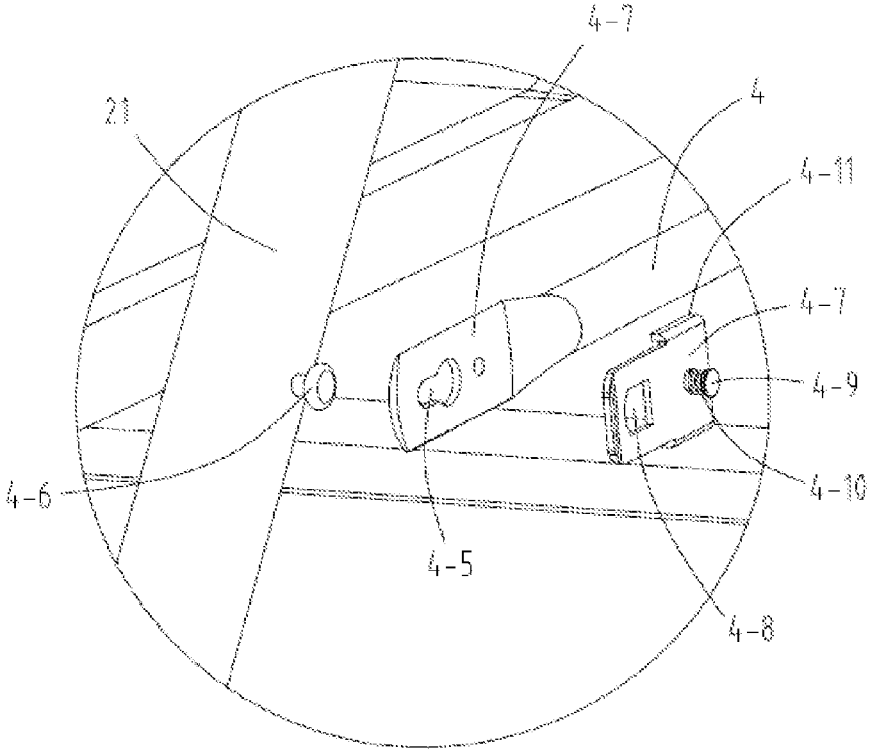
FIG. 4 is an exploded view of a connection structure of a connecting rod and a connecting buckle of the present invention.
Figure 5:
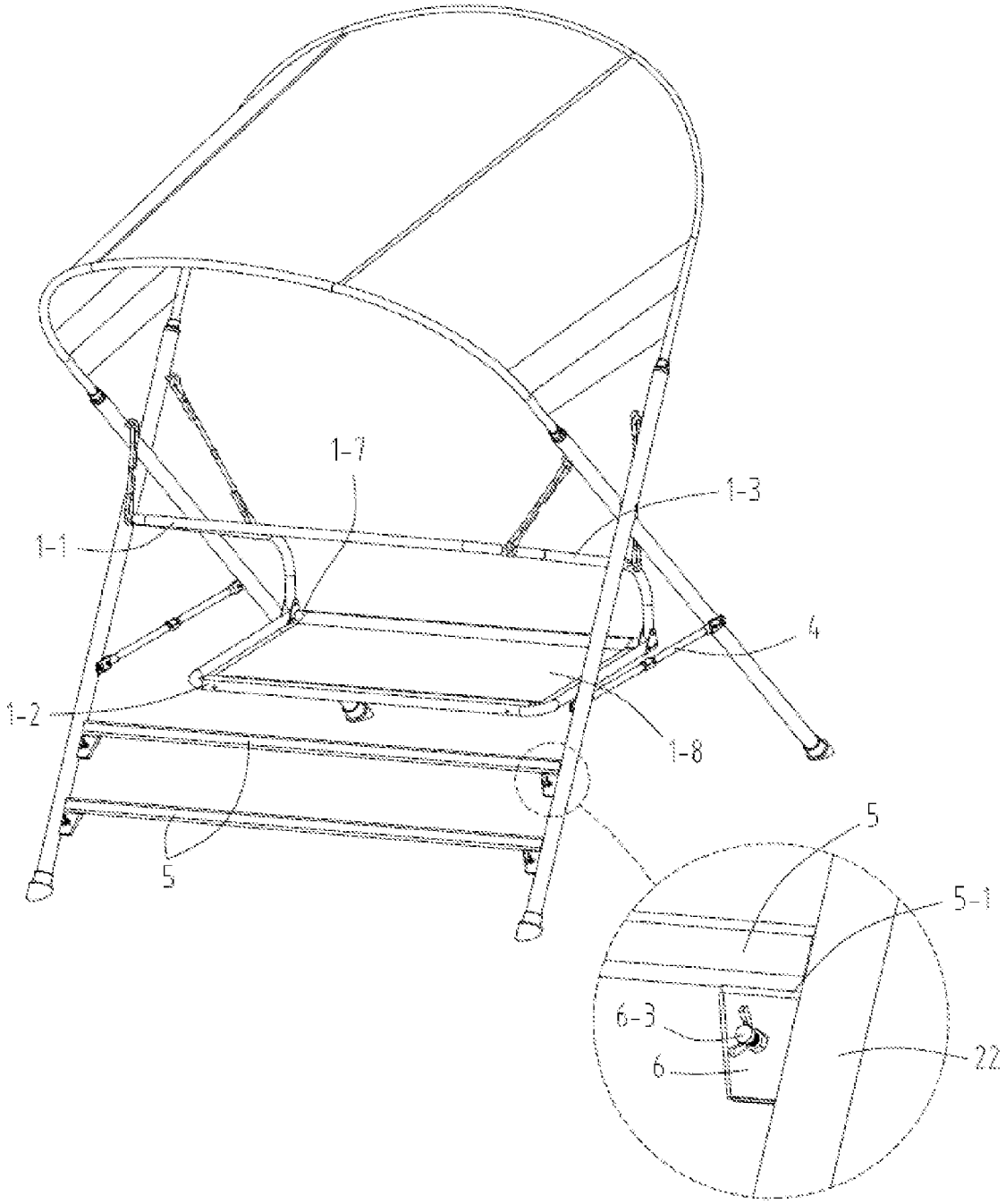
FIG. 5 is a rear view of the overall structure of the present invention in the unfolded state.
Figure 6:
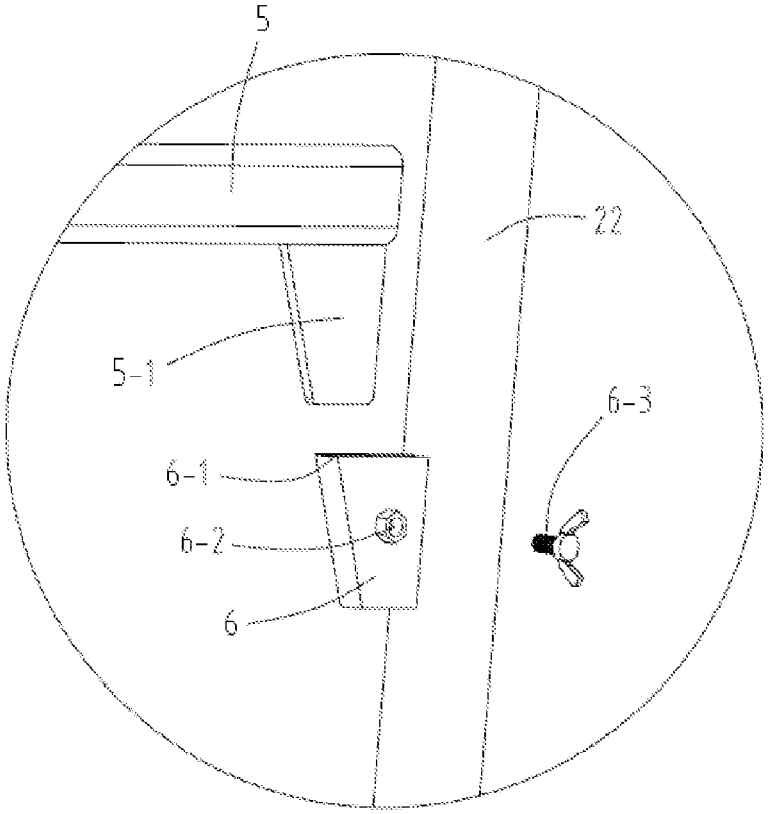
FIG. 6 is an exploded view of a connection structure of an insert and a positioning portion of the present invention.

Reference numerals in the drawings: 1. swing seat; 1-1. backrest frame body; 1-2. cushion frame body; 1-3. armrest frame body; 1-4. second connector; 1-5. connecting hole; 1-6. flexible support material; 1-7. cross rod; 1-8. cloth cover; 1-9. latch; 2. support frame; 21. first support rod; 22. second support rod; 23. hinged point; 3. hanger; 31. hanging rod; 32. hook; 4. connecting rod; 4-1. first rod portion; 4-2. second rod portion; 4-3. first connector; 4-4. gap; 4-5. gourd hole; 4-6. snap-in post; 4-7. connecting buckle; 4-8. limiting hole; 4-9. fastener; 4-10. spring; 4-11. bent portion; 4-12. movable gap; 5. transverse support rod; 5-1. insert; 6. positioning portion; 6-1. slot; 6-2. screw hole; 6-3. locking bolt; 7. first shackle; 8. second shackle; 10. first mounting rod; 11. second mounting rod; and 12. canopy.

DESCRIPTION OF THE EMBODIMENTS

The technical solutions in the embodiments of the present invention will be clearly and completely described below in conjunction with the accompanying drawings in the embodiments of the present invention. Obviously, the described embodiments are only part but not all of the embodiments of the present invention. All other embodiments obtained by a person of ordinary skill in the art based on the embodiments of the present invention without creative efforts shall fall within the protection scope of the present invention.

As shown in FIGS. 1-8, a foldable swing includes support frames 2 and a swing seat 1, where the swing seat 1 is connected to the support frame 2 by hangers 3, the support frames 2 are respectively arranged on left and right sides of the swing seat 1, each support frame 2 includes a first support rod 21, a second support rod 22 and a connecting rod 4, the first support rod 21 and the second support rod 22 are hingedly connected to each other, so that the first support rod 21 and the second support rod 22 are rotatable about a hinged point 23 to achieve folding, and both ends of the connecting rod 4 are connected to the first support rod 21 and the second support rod 22 respectively to limit an unfolding angle between the first support rod 21 and the second support rod 22.

Preferably, in the present embodiment, the connecting rod 4 is located at a lower portion of the hinged point 23 of the first support rod 21 and the second support rod 22.

As shown in FIGS. 2-5, the connecting rod 4 is transversely located between the first support rod 21 and the second support rod 22, the both ends of the connecting rod 4 are respectively movably connected to the first support rod 21 and the second support rod 22, the both ends of the connecting rod 4 are respectively provided with a gourd hole 4-5, the gourd holes 4-5 are also transversely arranged, the gourd hole 4-5 include two holes with different aperture sizes and in communication, a snap-in post 4-6 is provided on the first support rod 21 and the second support rod 22 respectively, the snap-in post 4-6 is inserted into the hole with the larger aperture size and then slides into the hole with the smaller aperture size, so that the snap-in post 4-6 forms a limiting fit with the hole with the smaller aperture to restrict the connecting rod 4 from displacing outward and running out.

In the present embodiment, an end portion of the connecting rod 4 is flat, so that the gourd hole 4-5 and the snap-in post 4-6 form a snap-fit; a mounting hole is further provided on the connecting rod 4, a connecting buckle 4-7 is further mounted at the end portion of the connecting rod 4, a threaded hole is correspondingly provided on the connecting buckle 4-7, a fastener 4-9, such as a screw and a bolt, is provided in the threaded hole, and the fastener 4-9 passes through the threaded hole and is then inserted into the mounting hole, so that the connecting buckle 4-7 is detachably connected to the end portion of the connecting rod 4; a limiting hole 4-8 is provided on the connecting buckle 4-7, and the limiting hole 4-8 is aligned with the hole with the smaller aperture size at the end portion of the connecting rod 4; after the connecting buckle 4-7 is connected to the end portion of the connecting rod 4, a top end of the snap-in post 4-6 is just located at the limiting hole 4-8 to form a limit to prevent the snap-in post 4-6 from sliding to the larger hole of the gourd hole 4-5, and the end portion of the connecting rod 4 is fixedly connected with the corresponding support rod. Preferably, the fastener 4-9 passes through the connecting buckle 4-7 and is then fastened in the mounting hole on the connecting rod 4, and a spring 4-10 is abutted between the connecting buckle 4-7 and a cap portion of the fastener 4-9, so that the connecting buckle 4-7 is initially fitted to the end portion of the connecting rod 4, and applying a force to the connecting buckle 4-7 causes the connecting buckle to displace outward to detach the limiting hole 4-8 from the snap-in post 4-6, and then the snap-in post 4-6 can be disengaged from the gourd hole 4-5, achieving quick disassembly or mounting between the connecting rod 4 and the first support rod 21 or the second support rod 22.

In the present embodiment, the connecting buckle 4-7 is a flat plate-like structure, two longitudinally opposite edges of the connecting buckle 4-7 are bent to form a bent portion 4-11, and the two bent portions 4-11 form a snap-fit limit with both sides of the end portion of the connecting rod 4, that is, the connecting buckle 4-7 and the connecting rod 4 form a longitudinal limit by the bent portion 4-11, so that the connecting buckle 4-7 does not shift randomly, extending the life of a connection between the connecting buckle 4-7 and the connecting rod 4.

Further, the connecting rod 4 is disconnected in the middle, forming a first rod portion 4-1 and a second rod portion 4-2; outer ends of the first rod portion 4-1 and the second rod portion 4-2 are respectively connected to the first support rod 21 and the second support rod 22, and inner ends thereof are connected to each other by a first connector 4-3; and the first connector 4-3 is respectively provided with an opening at both ends, and the inner ends of the first rod portion 4-1 and the second rod portion 4-2 are respectively inserted into the openings of the first connector 4-3 and are hinged with the first connector 4-3 by positioning pins.

In the present embodiment, the first connector 4-3 is a U-shaped member which forms a movable hoop-type connection between end portions of the first rod portion 4-1 and the second rod portion 4-2; a movable gap 4-12 is left between the end portion of the first rod portion 4-1 and an inner wall of the first connector 4-3 and between the end portion of the second rod portion 4-2 and the inner wall of the first connector 4-3, so that the first rod portion 4-1 and the second rod portion 4-2 rotate along the first connector 4-3 to form folding; a gap 4-4 communicating with the opening is formed on one side of the first connector 4-3, and the gap 4-4 is arranged downward, so that the first rod portion 4-1 and the second rod portion 4-2 can only rotate downward for folding, so that the first connector 4-3 forms a limit on the upward rotation of the connecting rod 4, preventing the connecting rod 4 from folding upward and causing the first connector 4-3 to contact the ground, and improving stability of the connecting rod 4 in an unfolded state.

A transverse support rod 5 is provided between the second support rods 22 on both sides, both ends of the transverse support rod 5 are respectively provided with an insert 5-1, the insert 5-1 is arranged downward, the insert 5-1 is integrally connected with the transverse support rod 5, and the insert 5-1 is a sheet-like structure with a thin thickness. A positioning portion 6 is respectively provided on the two second support rods 22, the positioning portion 6 is a flat blocky structure, the positioning portions 6 is integrally connected with the support rods, a slot 6-1 is provided on the positioning portion 6, and an opening of the slot 6-1 faces upward; when the insert 5-1 of the transverse support rod 5 is inserted downward from the opening into the slot 6-1, the transverse support rod 5 is connected with the second support rod 22; a screw hole 6-2 is provided on a surface of the positioning portion 6, the screw hole 6-2 is communicated with the slot 6-1, and a locking bolt 6-3 is screwed into the screw hole 6-2; and a top portion of the locking bolt 6-3 abuts against a surface of the insert 5-1 to lock the insert 5-1, thereby locking the insert 5-1 and the positioning portion 6, such that a stable detachable connection is formed between the transverse support rod 5 and the second support rod 22.

Preferably, a bottom end of the insert 5-1 is fixedly connected with the transverse support rod 5, and a length dimension of a top end of the insert 5-1 is smaller than a length dimension of the bottom end thereof, which plays a guiding role for the insertion of the top end of the insert 5-1 from the opening, and the insertion of the insert 5-1 into the slot 6-1 further stabilizes the insert in the slot 6-1.

Preferably, the positioning portion 6 is a bent plate, the plate-like structure is bent to form two bent portions, a gap is formed between the two portions as the slot 6-1, one side of the bent plate is integrally connected with the second support rod 22, and the bent plate structure reduces the thickness dimension after folding.

Preferably, the transverse support rods 5 are two or more in number and are arranged in parallel on the second support rod 22 along a length direction of the second support rod 22. That is, the transverse support rods are distributed up and down along the second support rod 22, thereby enhancing stability between the two second support rods 22.

In the present embodiment, the swing seat 1 includes a backrest frame body 1-1 and a cushion frame body 1-2; the backrest frame body 1-1 is located on a rear side of the cushion frame body 1-2, and the backrest frame body 1-1 and the cushion frame body 1-2 are both formed by enclosing a tube structure; both ends of the backrest frame body 1-1 extend forward and bend downward to form an armrest frame body 1-3, that is, the backrest frame body 1-1 and the armrest frame body 1-3 are integrated; a second connector 1-4 is provided between a top end of the armrest frame body 1-3 and the cushion frame body 1-2, and a connecting hole 1-5 is provided on the cushion frame body 1-2; the second connector 1-4 is fixedly connected to the connecting hole 1-5 by a latch 1-9, and a fixed connection is formed between the second connector 1-4 and the cushion frame body 1-2; and the second connector 1-4 is a U-shaped member, and an opening of the second connector 1-4 is hinged with an end portion of the armrest frame body 1-3, so that the backrest frame body 1-1 together with the armrest frame body 1-3 and the cushion frame body 1-2 are foldable relative to each other.

A flexible support material 1-6 is respectively provided between the backrest frame body 1-1 and the cushion frame body 1-2 and between the armrest frame body 1-3 and the cushion frame body 1-2 as a support surface, and the flexible support material 1-6 can be freely deformed, which facilitates folding of the swing and reduces the weight.

A first shackle 7 is respectively provided at both ends of the armrest frame body 1-3, a second shackle 8 is respectively provided on the first support rod 21 and the second support rod 22, and the first shackle 7 and the second shackle 8 are respectively fixed with the armrest frame body 1-3 and the support rods by welding; the hanger 3 includes four hanging rods 31, both ends of each hanging rod 31 form a hook 32, the hanging rods 31 are distributed on both sides of the swing seat 1 in pair, the hooks 32 on one end of the two hanging rods 31 on the same side are respectively hooked to the corresponding first shackle 7, and the hooks on the other end are respectively hooked to the second shackles 8 on the first support rod 21 and the second support rod 22, that is, the armrest frame body 1-3 are suspended by hooks 32 to the first support rod 21 and the second support rod 22 respectively, which improves connection stability of the swing seat 1 and the support rods, so that the whole swing is more stable.

A first mounting rod 10 is provided between top ends of the two first support rods 21, a second mounting rod 11 is provided between top ends of the two second support rods 22, the second mounting rod 11 and the first mounting rod 10 are arranged one in front of the other, and the second mounting rod 11 and the first mounting rod 10 are both in a bent state, so that a canopy 12 is provided between the second mounting rod 11 and the first mounting rod 10.

Figure 7:
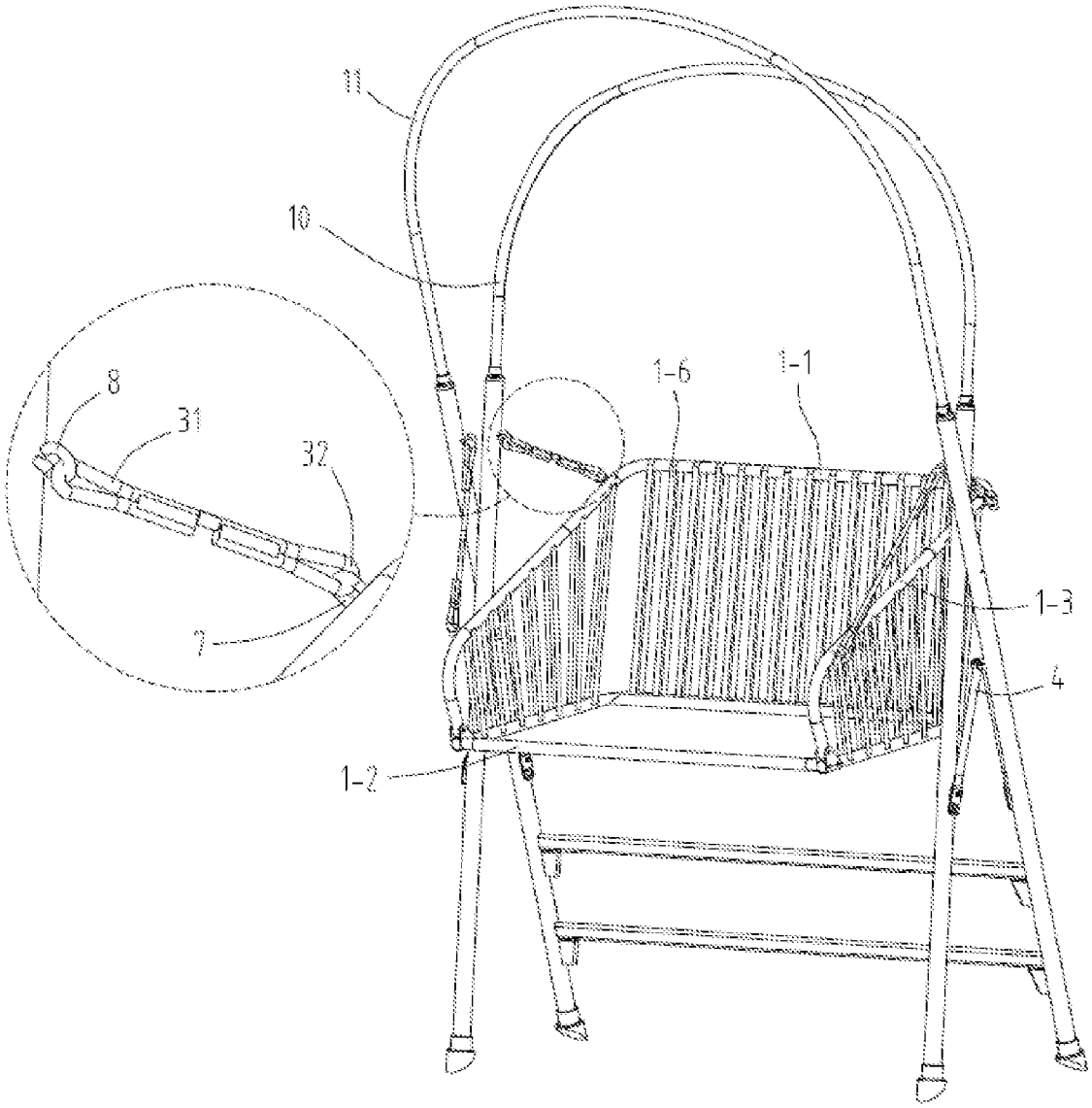
FIG. 7 is a front view of an overall structure of a first support rod and a second support rod of the present invention in a folded state.
Figure 8:
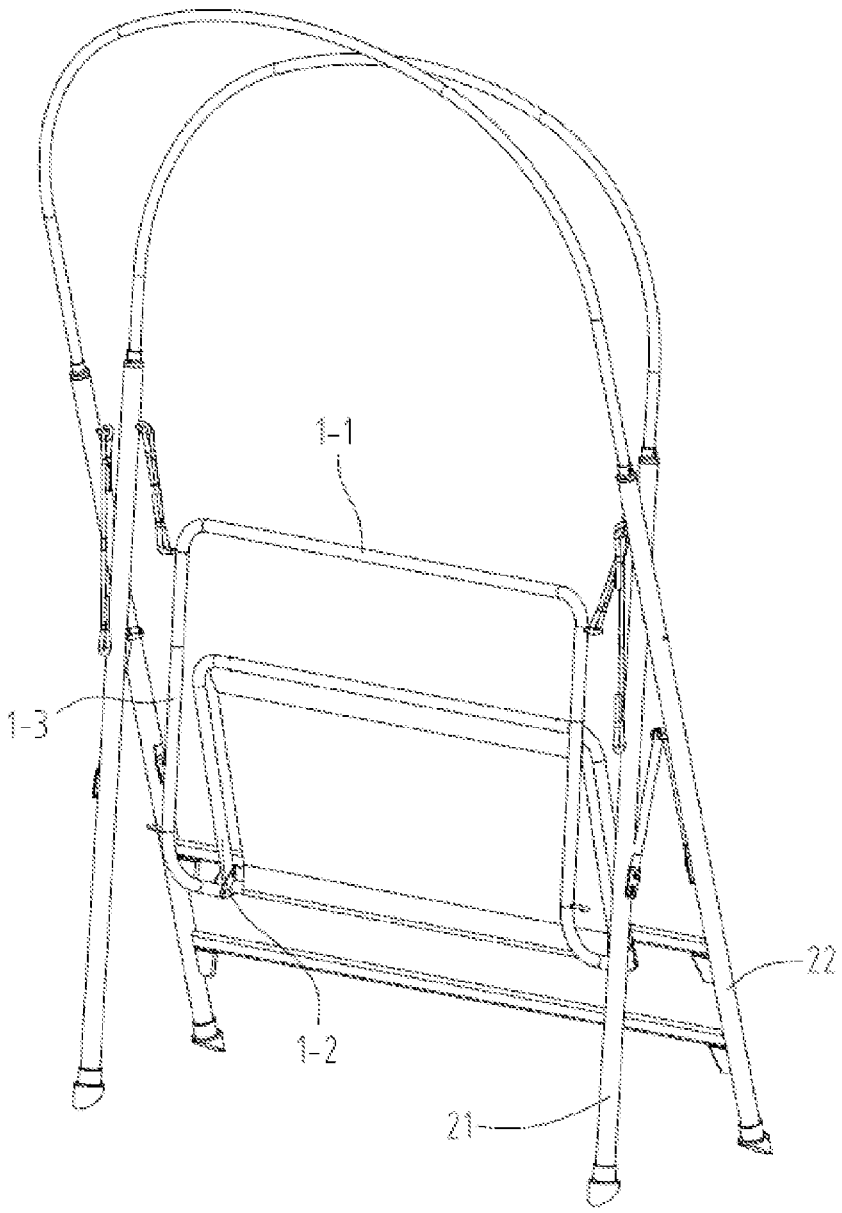
FIG. 8 is a front view of an overall structure of the present invention in a folded state.

The foldable swing has an unfolded state and a folded state. When in the unfolded state, as shown in FIG. 1, the first support rod 21 and the second support rod 22 rotate around the hinged point 23 to unfolded each other, then the backrest frame body 1-1 and the cushion frame body 1-2 unfold each other around the second connector 1-4 to form a seat state, and at this time, the connecting rod 4 is in a straight state, the both ends of the connecting rod 4 are connected to the first support rod 21 and the second support rod 22 by the connecting buckle 4-7, and at this time, the first mounting rod 10 and the second mounting rod 11 are respectively unfolded along with the first support rod 21 and the second support rod 22. When in the folded state, as shown in FIG. 7, the first support rod 21 and the second support rod 22 rotate around the hinged point 23 to form the folded or nearly folded state, then the backrest frame body 1-1 and the cushion frame body 1-2 rotate with each other around the corresponding hinged point 23 to form the folded or nearly folded state, at this time, the connecting buckle 4-7 is adjusted to form a movable state between the both ends of the connecting rod 4 and the corresponding support rod, so that when the two support rods rotate with each other, the connecting rod 4 also rotates around the first connector 4-3 to form the folded state, and as shown in FIG. 8, finally folding is formed between the first support rod 21 and the second support rod 22 and between the backrest frame body 1-1 and the cushion frame body 1-2.

Further, both ends of the first mounting rod 10 are respectively inserted into the top ends of the two first support rods 21, both ends of the second mounting rod 11 are respectively inserted into the top ends of the two second support rods 22, the mounting rod and the support rods are sheathed together and form a limit by an elastic pin, and when disassembly is required, the mounting rod and the support rods can be separated by simply pressing the elastic pin.

In another embodiment, the flexible support material 1-6 is a cloth belt, one end of the cloth belt is wound and connected to the backrest frame body 1-1 and the armrest frame body 1-3, and the other end is wound and connected to the cushion frame body 1-2; and front and rear sides of the cushion frame body 1-2 are also detachably connected with cross rods 1-7, a cloth strip or cloth cover 1-8 is provided between the two cross rods 1-7, and front and rear ends of the cloth strip or cloth cover 1-8 are respectively wound and connected to the corresponding cross rod 1-7, so that a cushion surface formed by the two cross rods 1-7 can be integrally assembled and disassembled, which is very convenient.

Figure 9:
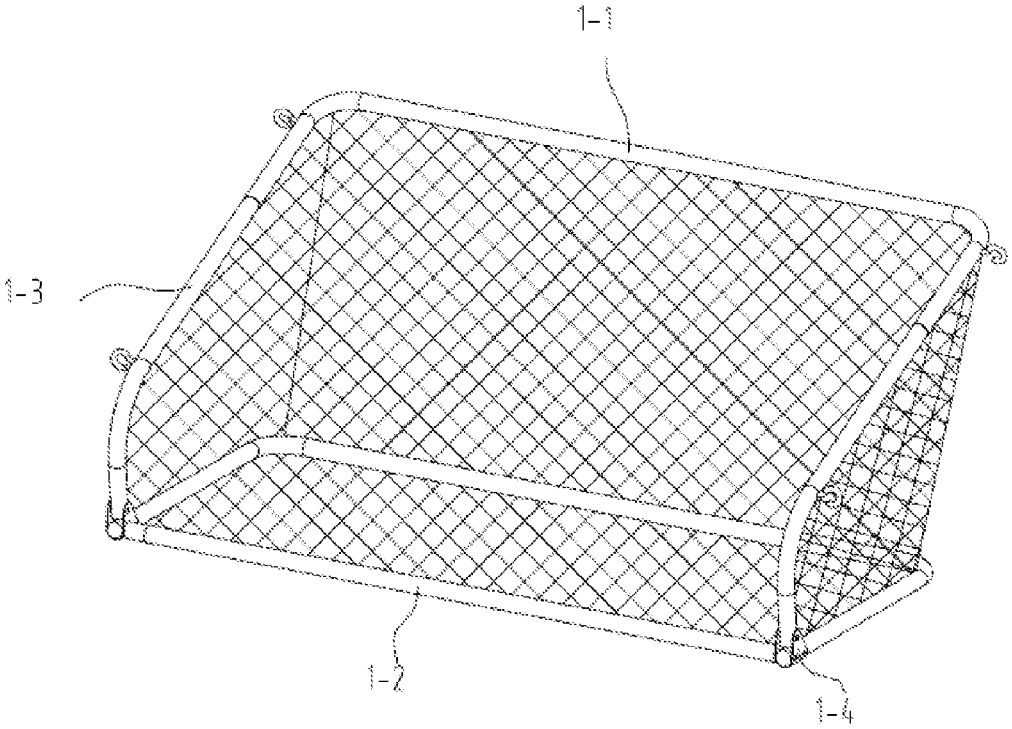
FIG. 9 is a schematic diagram of a structure in which a support surface of a swing seat of the present invention is a rattan woven structure.

In another embodiment, as shown in FIG. 9, the flexible support material 1-6 is a rattan or mesh surface, and the rattan or mesh surface is used as a support surface between the backrest frame body 1-1 and the cushion frame body 1-2, between the armrest frame body 1-3 and the cushion frame body 1-2 and inside the cushion frame body 1-2 respectively.

Figure 10:
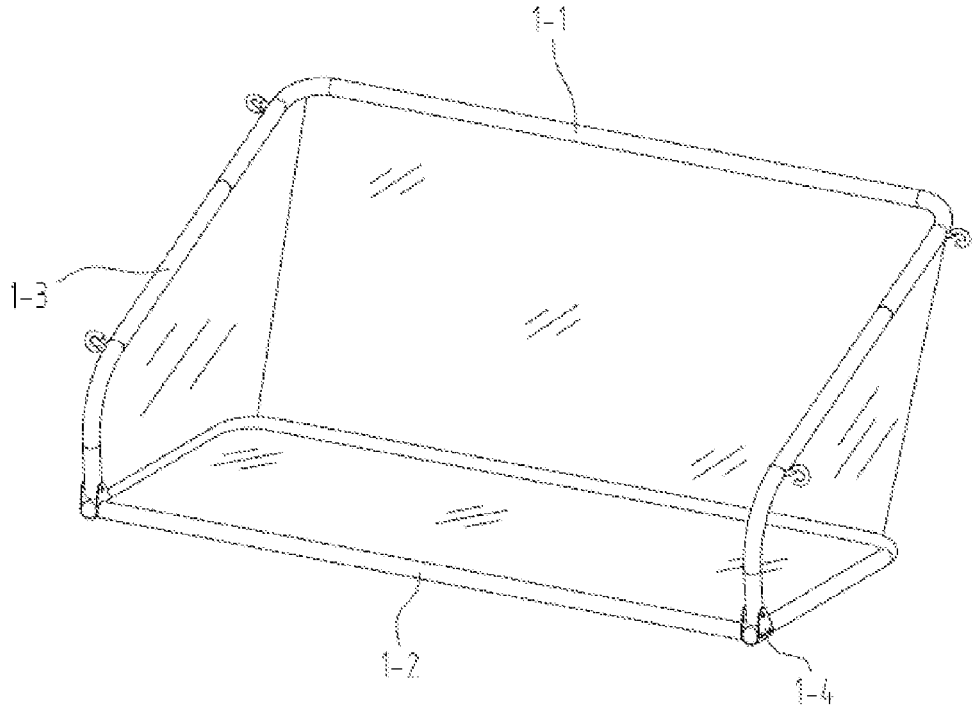
FIG. 10 is a schematic diagram of a structure in which a support surface of a swing seat of the present invention is a sponge structure.

In another embodiment, as shown in FIG. 10, the flexible support material 1-6 is a sponge structure, and the sponge structure is used as the support surface between the backrest frame body 1-1 and the cushion frame body 1-2, between the armrest frame body 1-3 and the cushion frame body 1-2 and inside the cushion frame body 1-2 respectively.

In another embodiment, as shown in FIG. 1, the shape of the first mounting rod 10 and the second mounting rod 11 is as follows: in the first embodiment, the both ends of the first mounting rod 10 and the second mounting rod 11 are respectively connected to the first support rod 21 and the second support rod 22 and are then both bent to form a circular arc shape, and a canopy cloth is connected between the second mounting rod 11 and the first mounting rod 10 to form a canopy 12 with a curved surface shape.

Figure 11:
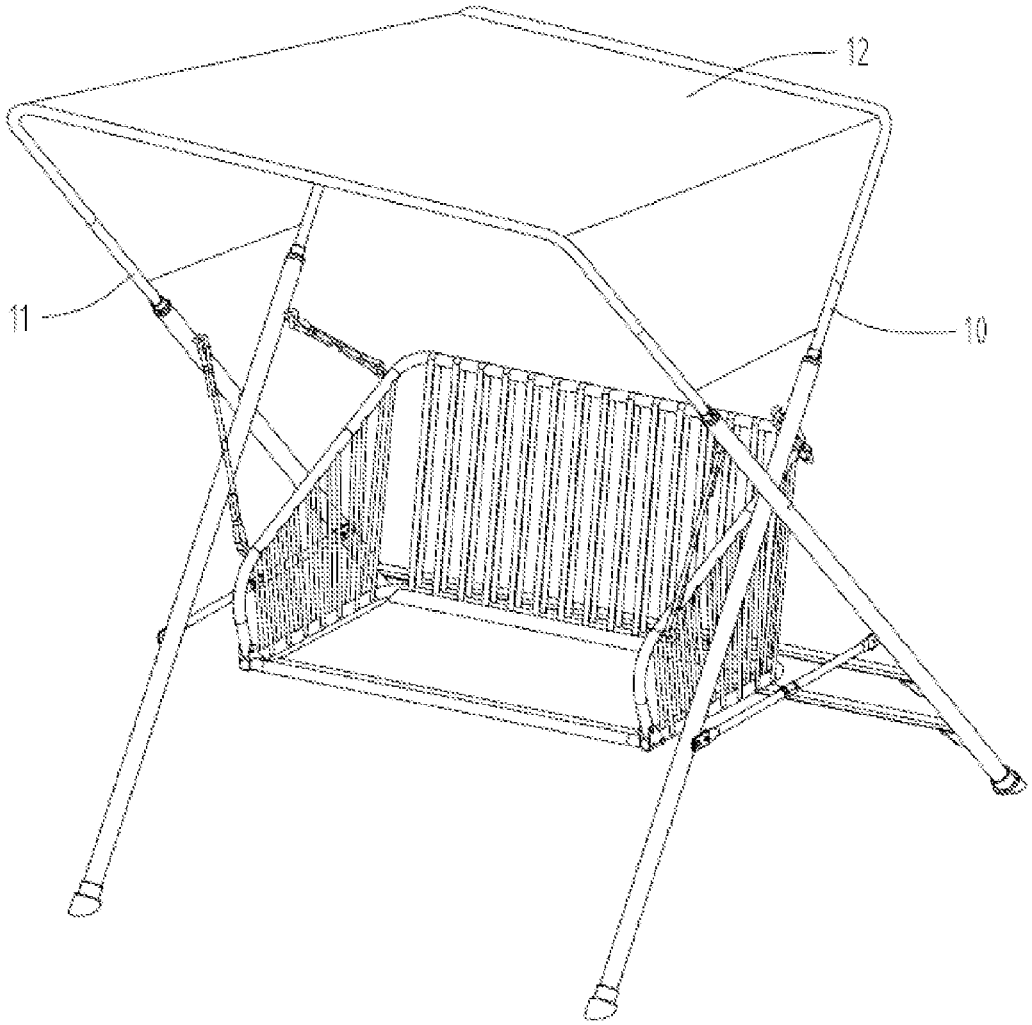
FIG. 11 is a schematic diagram of a structure in which a first mounting rod and the second mounting rod of the present invention are square.

In another embodiment, as shown in FIG. 11, the shape of the first mounting rod 10 and the second mounting rod 11 is as follows: in the present embodiment, the both ends of the first mounting rod 10 and the second mounting rod 11 are respectively connected to the first support rod 21 and the second support rod 22 and are then bent to form a square shape; and a canopy cloth is connected between the second mounting rod 11 and the first mounting rod 10 to form a planar canopy 12, or a planar canopy 12 having bent right angles on both sides.

In another embodiment, the hanging rod 31 may be replaced with a rope or chain, both ends of which are connected to the first shackle 7 and the second shackle 8 respectively, and one end of the hanging rod 31 may be disconnected from one of the shackles when folding is required.

In another embodiment, the first support rod 21, the second support rod 22, the first mounting rod 10, and the second mounting rod 11 may be round tube structures, square tube structures, or a free combination of a round tube and a square tube.

What is claimed is:

1. A foldable swing, comprising:

a swing seat, support frames provided on two sides of the swing seat, and hangers, wherein the swing seat is connected to the support frames by the hangers, each of the support frames comprises a first support rod, a second support rod and a connecting rod, the first support rod and the second support rod are hingedly connected, and both ends of the connecting rod are respectively connected to the first support rod and the second support rod and deviate from a hinged point to limit an unfolding angle of the first support rod and the second support rod;

the swing seat comprises a backrest frame body and a cushion frame body, and the backrest frame body is hinged with the cushion frame body;

the foldable swing has an unfolded state and a folded state, in the unfolded state, the first support rod and the second support rod are rotated about the hinged point for unfolding, and the backrest frame body and the cushion frame body form a seat state, and in the folded state, the first support rod and the second support rod overlap, and the backrest frame body and the cushion frame body are rotated for folding; and the backrest frame body is located on a rear side of the cushion frame body, both ends of the backrest frame body extend forward to form an armrest frame body, a second connector is provided between a lower end of the armrest frame body and the cushion frame body, a connecting hole is provided on the cushion frame body, the second connector is fixedly connected to the connecting hole by a latch, and the lower end of the armrest frame body is hinged to the second connector, so that the backrest frame body together with the armrest frame body and the cushion frame body are foldable relative to each other.

2. The foldable swing according to claim 1, wherein a support material is respectively provided between the backrest frame body and the seat cushion frame body, between the armrest frame body and the seat cushion frame body and within the seat cushion frame body as a support surface, and the support material is a cloth belt, a rattan or mesh surface or a sponge structure.

3. The foldable swing according to claim 2, wherein a first shackle is respectively provided at both ends of the armrest frame body, a second shackle is respectively provided on the first support rod and the second support rod, the hanger comprises four hanging rods, both ends of each hanging rod form a hook, the hanging rods are distributed on both sides of the swing seat in pair, the hooks on one end of the two hanging rods on the same side are respectively hooked to the corresponding first shackle, and the hooks on the other end are respectively hooked to the second shackles on the first support rod and the second support rod.

4. The foldable swing according to claim 1, wherein the both ends of the connecting rod are respectively provided with a gourd hole, a snap-in post forming plug-in fit with the corresponding gourd hole are provided on the first support rod and the second support rod respectively, the gourd hole is provided with a connecting buckle by a fastener, a limiting hole for limiting the snap-in post is provided on the connecting buckle, and a spring is provided between the fastener and the connecting buckle.

5. The foldable swing according to claim 4, wherein an end portion of the connecting rod is flat, the connecting buckle is tightly attached to the end portion of the connecting rod, and an edge of the connecting buckle is bent to form a limit with both sides of the end portion of the connecting rod.

6. The foldable swing according to claim 5, wherein the connecting rod is disconnected in the middle to form a first rod portion and a second rod portion, one end of the first rod portion and one end of the second rod portion are respectively connected to the first support rod and the second support rod, and a first connector is provided between the other ends, both ends of the first connector are respectively provided with an opening, end portions of the first rod portion and the second rod portion are respectively inserted into the openings of the first connector and are hinged with the first connector by positioning pins, a movable gap is left between the end portion of the first rod portion and an inner wall of the first connector and between the end portion of the second rod portion and the inner wall of the first connector, a gap communicating with the opening is formed one side of the first connector, and the gap is arranged downward.

7. The foldable swing according to claim 1, wherein a transverse support rod is provided between the second support rods, both ends of the transverse support rod are provided with inserts, a positioning portion is provided on the second support rods respectively, a slot for the insert to be inserted downward is provided on the positioning portion, a screw hole communicating with the slot is provided on the positioning portion, a locking bolt is screwed into the screw hole, and a top portion of the locking bolt abuts against a surface of the insert to lock the insert.

8. The foldable swing according to claim 7, wherein the positioning portion is a bent plate structure, the positioning portion is bent to form a gap as the slot, and the positioning portion and the second support rod are integrally arranged.

9. The foldable swing according to claim 7, wherein the transverse support rods are two or more in number.

10. The foldable swing according to claim 1, wherein a first mounting rod is provided between top ends of the two first support rods, a second mounting rod is provided between top ends of the two second support rods, the second mounting rod and the first mounting rod are arranged one in front of the other, and a canopy is provided between the second mounting rod and the first mounting rod.

11. The foldable swing according to claim 10, wherein both ends of the first mounting rod are respectively detachably inserted into the top ends of the two first support rods, and both ends of the second mounting rod are respectively detachably inserted into the top ends of the two second support rods.

* * * * *